US006866187B2

(12) United States Patent
Reagan et al.

(10) Patent No.: US 6,866,187 B2
(45) Date of Patent: Mar. 15, 2005

(54) LABORATORY TOTE

(75) Inventors: Elizabeth A. Reagan, Penfield, NY (US); Robert Gutkin, Pittsford, NY (US); Anita Gill, Rochester, NY (US)

(73) Assignee: Nalge Nunc International Corporation, Rochester, NY (US)

( * ) Notice: Subject to any disclaimer, the term of this patent is extended or adjusted under 35 U.S.C. 154(b) by 61 days.

(21) Appl. No.: 10/402,832

(22) Filed: Mar. 28, 2003

(65) Prior Publication Data

US 2004/0188505 A1 Sep. 30, 2004

(51) Int. Cl.[7] ..... B65D 5/462

(52) U.S. Cl. ..... 229/117.14; 229/117.13; 229/117.15; 229/120.15; 229/164; 229/178

(58) Field of Search ..... 229/117.12, 117.13, 229/117.14, 117.15, 120.15, 120.18, 164, 178, 939; 206/180

(56) References Cited

U.S. PATENT DOCUMENTS

| | | | | | |
|---|---|---|---|---|---|
| 2,008,443 | A | * | 7/1935 | Froehlig | 229/117.14 |
| 2,543,821 | A | * | 3/1951 | Arneson | 229/120.15 |
| 2,659,524 | A | * | 11/1953 | McElwee | 229/117.14 |
| 2,763,398 | A | * | 9/1956 | Moore | 229/117.15 |
| 2,821,328 | A | * | 1/1958 | Gilmour | 229/117.14 |
| 2,997,223 | A | * | 8/1961 | Zastrow | 229/117.13 |
| 3,158,286 | A | * | 11/1964 | Phillips, Jr. | 229/120.15 |
| 3,310,219 | A | | 3/1967 | Dlugopolski | |
| 3,394,863 | A | * | 7/1968 | Wood et al. | 229/117.14 |
| 3,837,973 | A | | 9/1974 | Asakura et al. | |
| 4,053,101 | A | * | 10/1977 | Hart, Jr. | 229/164 |
| 4,418,818 | A | * | 12/1983 | Stone | 229/120.18 |
| 4,828,894 | A | | 5/1989 | Taylor | |
| 4,948,039 | A | | 8/1990 | Amatangelo | |
| 5,221,001 | A | * | 6/1993 | Eisman | 206/180 |
| 5,337,947 | A | * | 8/1994 | Eskandry | 229/117.14 |
| 5,792,487 | A | | 8/1998 | Wenning et al. | |
| 6,089,638 | A | * | 7/2000 | Whitnell | 229/117.14 |
| 6,102,279 | A | | 8/2000 | Dowd | |
| 6,361,746 | B1 | | 3/2002 | Wlodarski | |
| 6,474,541 | B1 | | 11/2002 | Chu | |

OTHER PUBLICATIONS

The Wiley Encyclopedia of Packaging Technology, John Wiley & Sons, pp. 226–228 (1986).*

Fischer Scientific, *Bottles* (*Carriers*), Sales Catalog, p. 223, date unknown.

Fisher Scientific, *Pumps* (*Vacuum–Accessoreis*)/*Racks* (*Bottle*), Sales Catalog, p. 1491, date unknown.

Fisher Scientific, *Safety* (*Cans & Accessories*), Sales Catalog, p. 1491, date unknown.

Lab Safety Supply, *Bottles/Containers/Bottle Carriers*, Sales Catalog, p. 696, date unknown.

Cole–Parmer Instrument Company, *Labware Bottles —Wash*, Sales Catalog, p. 746, date unknown.

Cole–Parmer Instrument Company, *Labware Bottles —Sample*, Sales Catalog, p. 770, date unknown.

* cited by examiner

*Primary Examiner*—Gary E. Elkins
(74) *Attorney, Agent, or Firm*—Wood, Herron & Evans LLP

(57) ABSTRACT

A laboratory tote, formed from a single sheet of corrugated polymeric material, includes a receptacle portion defined by a bottom wall and respective end walls and sidewalls hingedly joined to opposing edges of the bottom wall. A handle extends between the sidewalls and above the receptacle to facilitate placement and removal of items into and out of the receptacle. The tote may be provided with a variety of partitions formed from separate removable components and configured to divide the receptacle into compartments of varying size, as desired.

10 Claims, 5 Drawing Sheets

LABORATORY TOTE

FIELD OF THE INVENTION

The present invention pertains to collapsible containers, and more particularly to a laboratory tote formed from corrugated polymeric material.

BACKGROUND OF THE INVENTION

In laboratory environments, it is often necessary to transport bottles and containers of chemicals, laboratory tools and instruments, safety equipment such as goggles, gloves, and masks, and cleaning supplies to and from workstations and storage areas. Further, in clinical laboratory settings, patient specimens, including blood or solid tissue samples, are frequently added to the list of items to be transported. Also, on occasion, it is desirable to keep a collection of various chemical reagents along with necessary accessories and a laboratory notebook together for easy transport or for fieldwork.

In order to aid laboratory personnel in performing their tasks, personnel may be provided with hand carried totes. Prior laboratory totes have typically been formed from polymer-coated wire or from polymeric materials that have been molded or otherwise fabricated into a rigid structure with a handle to provide a sturdy carrier with some degree of chemical resistance. While these totes are usually durable enough for most uses, they are also generally quite expensive, thus necessitating a level of permanence and requiring that the totes be routinely cleaned of chemical spills and drips, or decontaminated of biologically hazardous materials.

Another drawback of prior laboratory carriers is that they are generally configured to have either a single compartment or a fixed number of compartments for separating items to be transported. Accordingly, the number and dimensions of the compartments in prior totes cannot be varied to adequately store a variety of different items. Because prior carriers are made to fit only fixed sizes, shapes, and numbers of items, it has been necessary to have a separate carrier for almost every application. Prior totes are not practical for multipurpose use.

Also, polymer-coated wire totes are problematic in that the openness of the sides can lead to items falling out of the carrier. Furthermore, many prior totes are heavy and/or occupy an undesirably large amount of space when shipped or stored.

There is a need for a laboratory tote that overcomes the drawbacks of the prior art as described above.

SUMMARY OF THE INVENTION

The present invention provides an inexpensive, lightweight but sturdy laboratory carrier with the level of chemical resistance required for everyday laboratory use and the versatility needed for multipurpose use. The tote may be provided with removable compartments that can be reconfigured to vary in size and number in order to receive and store items of varying sizes. Advantageously, the main body of the tote is formed from a single blank of corrugated polymeric material, permitting easy assembly by folding the material along appropriately located fold lines, and engaging tabs within corresponding slots to stabilize the structure without the need for adhesives, staples, or rivets. Therefore, the tote is less expensive to fabricate than prior totes that require molding or that use adhesives or physical attachment means. Moreover, because no adhesives or metal staples and rivets are used, the tote is more resistant to chemicals that would otherwise dissolve adhesives or oxidize metal. The corrugated polymeric blanks are lightweight and may be stacked flat to permit convenient and efficient shipping and storage of totes prior to assembly or when not in use. Further, the tote is easily cleaned and decontaminated, or alternatively, it is inexpensive and can be disposed of when soiled.

In one aspect of the invention, the tote comprises a receptacle section or basket portion defined by a bottom wall, first and second end walls, and solid first and second sidewalls that extend upwardly from and beyond the top edges of the end walls to provide additional support to articles carried within the receptacle portion. The panels forming the end walls lock into place using one or more tabs that fit through corresponding slots in the bottom wall. The sturdiness and strength of the tote is due, in part, to a handle section formed from overlapping panels that further utilize a T-shaped flap with locking tabs to secure the handle structure. The T-shaped flap also provides a comfortable grip for the user by covering the raw edge of the cut corrugated polymer material. The handle portion extends between the upper regions of the sidewalls well above the receptacle portion to permit open access to the basket of the tote, facilitating easy placement and removal of items.

In another aspect of the invention, the tote may be provided with varying numbers and sizes of compartments by means of a separate partition formed from two or more slats of suitable material. Slots cut in the slats facilitate interconnection of two or more slats to form compartments in the partition. The slats can be arranged in a number of different partition patterns to alter the number and/or size of the compartments. Moreover, the compartments within a particular arrangement need not be of the same size, but rather, can be varied to provide smaller and larger compartments simultaneously. To increase the number of arrangement possibilities, each slat may be formed with different slot patterns on each opposite edge of the slat, so that a slat may be turned 180 degrees and used for a different compartmental arrangement.

In yet another aspect of the invention, a blank foldable into a laboratory tote comprises a single blank of corrugated polymeric material having one bottom panel, and first and second side panels and first and second end panels hingedly joined to the bottom panel. First and second pairs of flaps that reinforce the end walls are hingedly joined to opposing edges of the respective side panels. Handle panels are hingedly joined to the distal edge of each side panel. Partitions for forming internal compartments are provided as separate slats and may be composed of a different polymeric material from that of the main body, and need not be corrugated.

The features and objectives of the present invention will become more readily apparent from the following Detailed Description taken in conjunction with the accompanying drawings.

BRIEF DESCRIPTION OF THE DRAWINGS

The accompanying drawings, which are incorporated in and constitute a part of this specification, illustrate embodiments of the invention and, together with a general description of the invention given above, and the detailed description given below, serve to explain the invention.

DETAILED DESCRIPTION

Figure 1:
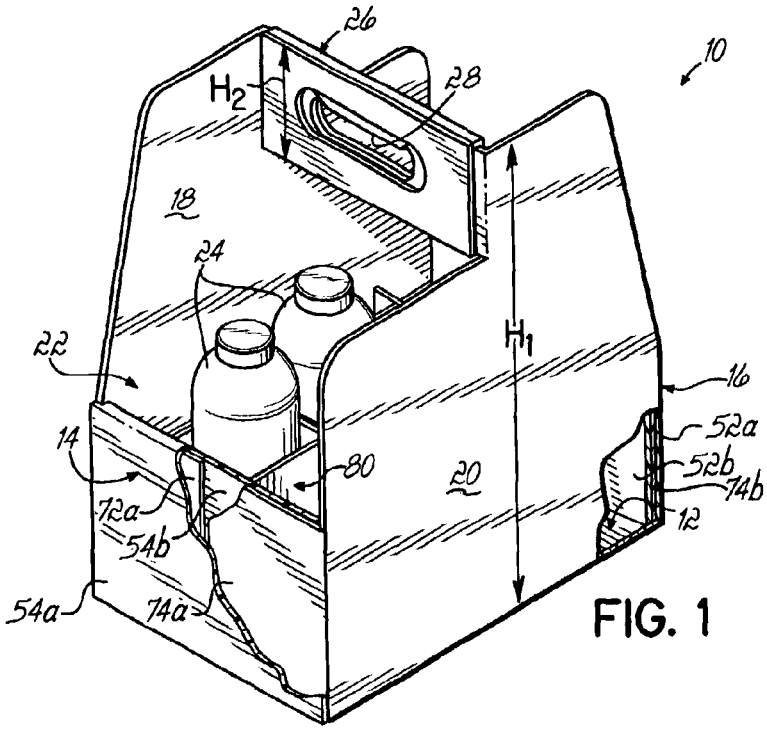
FIG. 1 is a perspective view of an exemplary laboratory tote of the present invention, including a partitioned insert.
Figure 3:
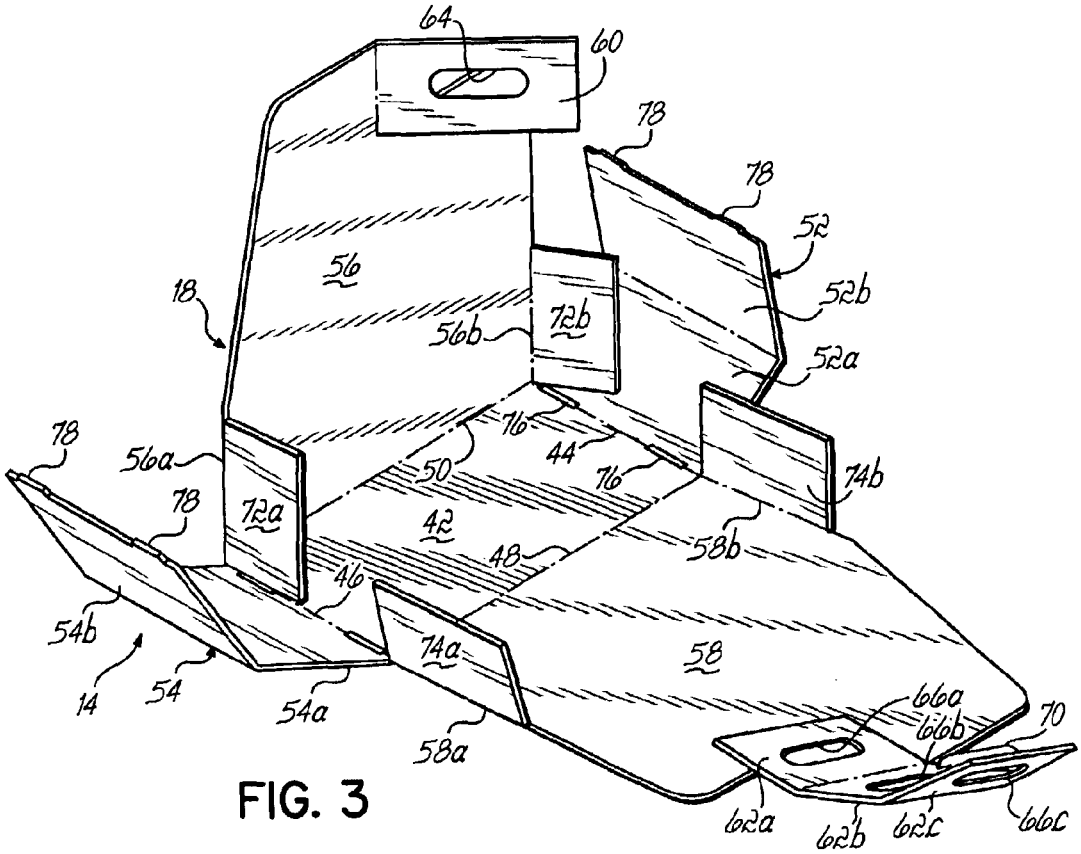
FIG. 3 is a perspective view of the corrugated polymeric blank of FIG. 2, illustrating initial folding of the blank to form the tote of FIG. 1.

Referring to FIGS. 1 and 3, there is shown an exemplary laboratory tote 10 of the present invention that has been assembled, with the exception of the insertable partition 80, from a single blank of corrugated polymeric sheet material that has been shaped, die cut, and provided with appropriately located fold lines. While the material described herein is commonly referred to as "corrugated" polymeric material, this term is intended to include such materials formed by sandwiching a corrugated, or folded layer between two relatively flat layers (similar to corrugated paperboard), materials formed by extrusion, and other functional equivalents. The corrugated polymeric material may be formed with one corrugated direction (e.g., three-ply corrugate) or it may have more than one corrugation direction (e.g., five-ply or cross-corrugate). Various polymers may be used to form the corrugated material, including polyethylene, vinyl, polystyrene, polypropylene, high density polyethylene or other polymers. Because the corrugated material is polymeric, it is well suited for use in environments having low particulate air requirements, such as facilities with "clean rooms" or "dry rooms."

The tote 10 comprises a bottom wall 12, first and second opposing end walls 14, 16 disposed along respective end edges 44, 46 of the bottom wall 14, and first and second opposing sidewalls 18, 20 disposed along respective side edges 48, 50 of the bottom wall 12 to define a receptacle 22 for receiving items, such as bottles 24 or other materials and accessories for convenient storage and carrying in the tote 10. Tote 10 further includes a handle portion 26 extending between the first and second sidewalls 18, 20, generally above the receptacle portion 22. The handle portion 26 is positioned a distance above the receptacle portion 22 to facilitate convenient placement of items into, and the removal of items from, the receptacle 22 and includes an aperture 28 sized to permit grasping of the handle portion 26 by a user.

Figure 2:
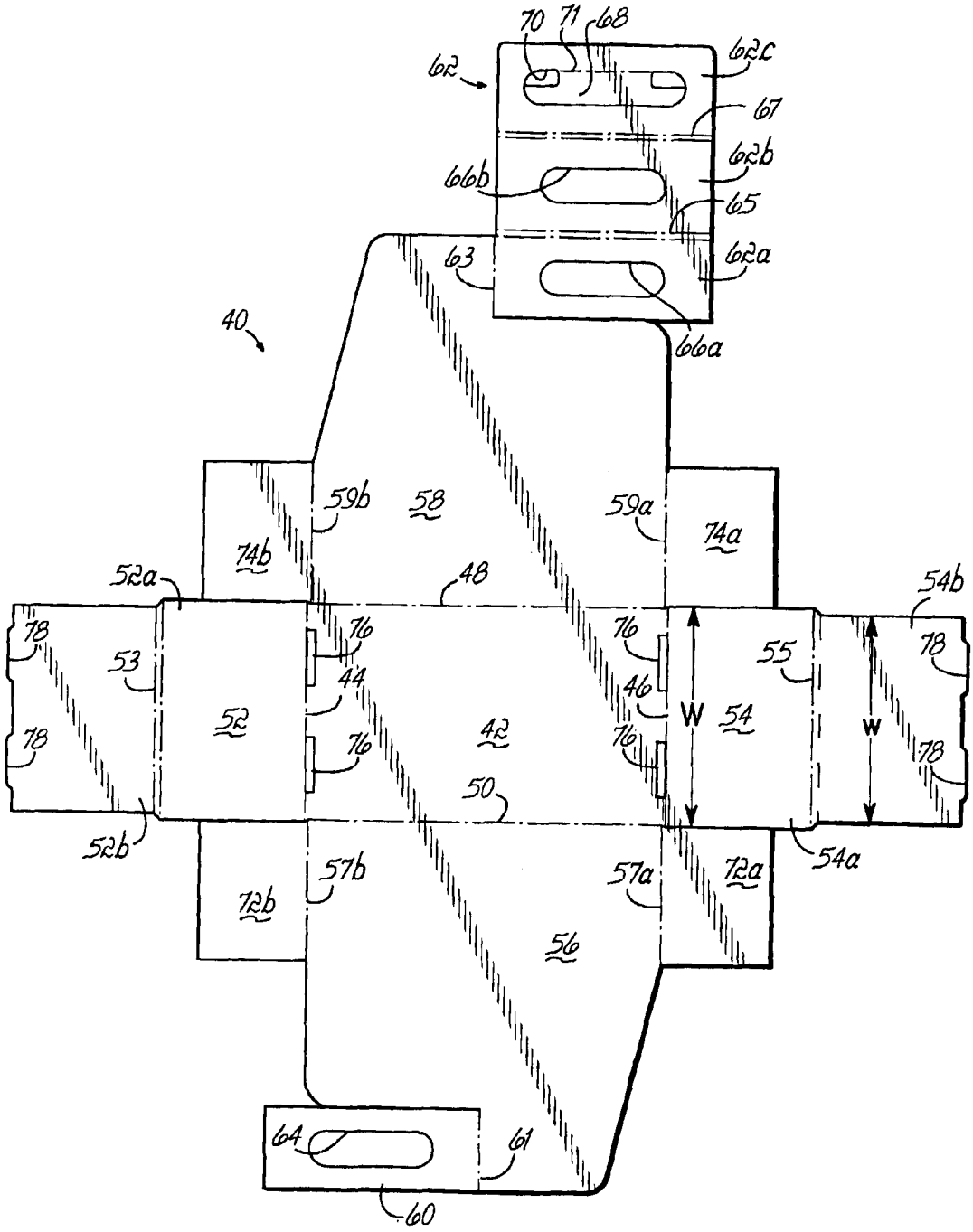
FIG. 2 is a plan view of an unfolded sheet of corrugated polymeric material, which has been shaped, die cut, and provided with appropriately located fold lines, to facilitate erection and assembly into the tote shown in FIG. 1.
Figure 4:
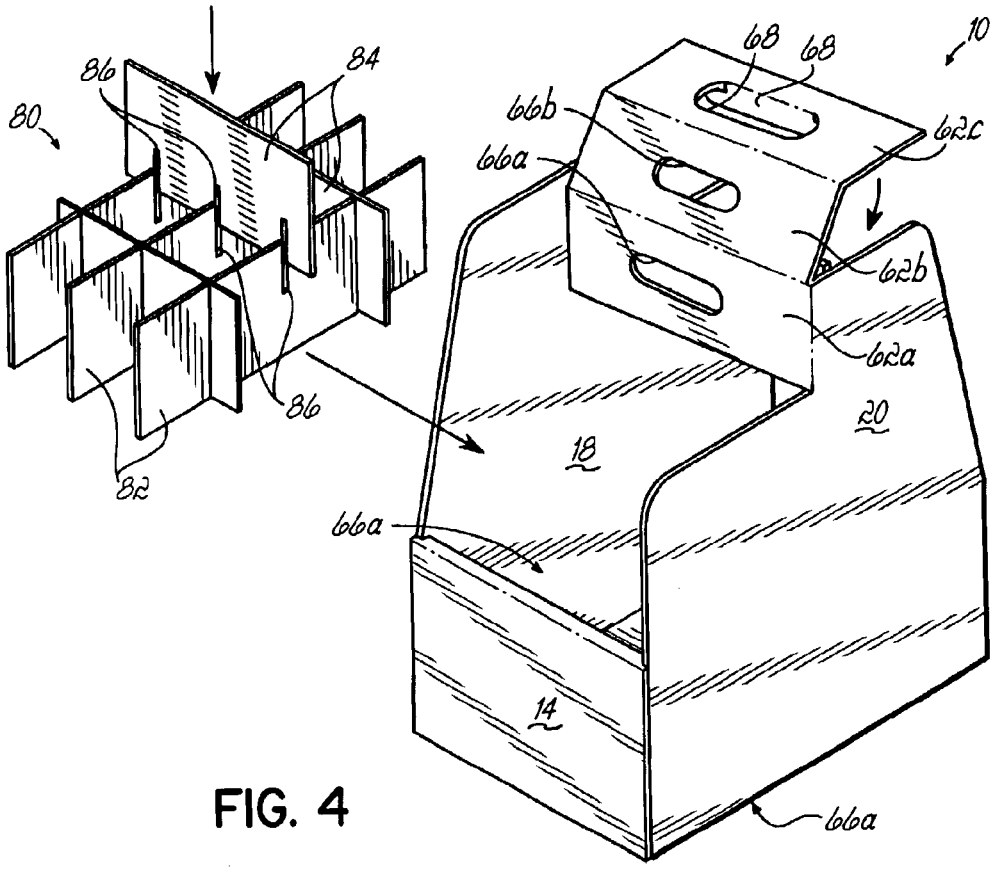
FIG. 4 is a perspective view of the folded blank of FIG. 3 immediately prior to formation of the tote handle and insertion of a partition into the receptacle section of the tote.

The exemplary tote 10 of FIG. 1 is formed by folding a blank 40, formed from a single sheet of corrugated polymeric material, for example a sheet having a thickness of approximately 3 mm, which has been appropriately shaped, die cut, and provided with properly located fold lines, as illustrated in FIGS. 2–4. Referring now to FIG. 2, the blank 40 includes a bottom panel 42 having first and second end edges 44, 46 and first and second side edges 48, 50 defined by fold lines formed in the corrugated polymeric blank. First and second end panels 52, 54 and first and second side panels 56, 58 are hingedly joined to bottom panel 42 along fold lines located at the respective end edges 44, 46 and side edges 48, 50. Each end panel 52, 54 is divided into proximal panel portions 52*a*, 54*a* and distal panel portions 52*b*, 54*b* by double fold lines 53 and 55, respectively. In the exemplary embodiment shown, distal panel portions 52*b*, 54*b* have width dimensions (w) that are narrower than the widths (W) of respective proximal panel portions 52*a*, 54*a* to facilitate folding of the distal panel portions 52*b*, 54*b* between the erected sidewalls 18, 20 to form end walls 14, 16, as will be described below.

In the exemplary embodiment shown in FIGS. 1–5, first and second handle panels 60, 62 are hingedly joined to first and second side panels 56, 58, respectively, along fold lines 61 and 63. The second handle panel 62 comprises three foldable portions 62*a*, 62*b*, 62*c* defined by fold lines 65, 67. The first handle panel 60 and the first and second foldable portions 62*a*, 62*b* of the second handle panel 62 include apertures 64, 66*a*, 66*b*, respectively, formed therethrough. The third foldable portion 62*c* of second handle panel 62 includes an aperture 70 which has been formed through the foldable portion 62*c* to define a T-shaped tongue 68 hingedly connected to the third foldable portion 62*c* along fold line 71. When tote 10 is assembled, aperture 64 in the first handle panel 60 and apertures 66*a*, 66*b* and 70 formed through the first, second and third foldable portions 62*a*, 62*b*, 62*c* of the second handle panel 62 cooperate to define handle aperture 28 of handle portion 26, as will be described below.

Blank 40 further includes a pair of first flaps 72*a*, 72*b* hingedly joined to first side panel 56 along opposite fold lines 57*a*, 57*b* and a pair of second flaps 74*a*, 74*b*, hingedly joined to second side panel 58 along opposite fold lines 59*a*, 59*b*, adjacent opposite sides of the first and second end panels 52, 54. As used herein, first flaps 72*a*, 72*b* and second flaps 74*a*, 74*b* will be respectively referred to collectively as first flaps 72 and second flaps 74.

Figure 5:
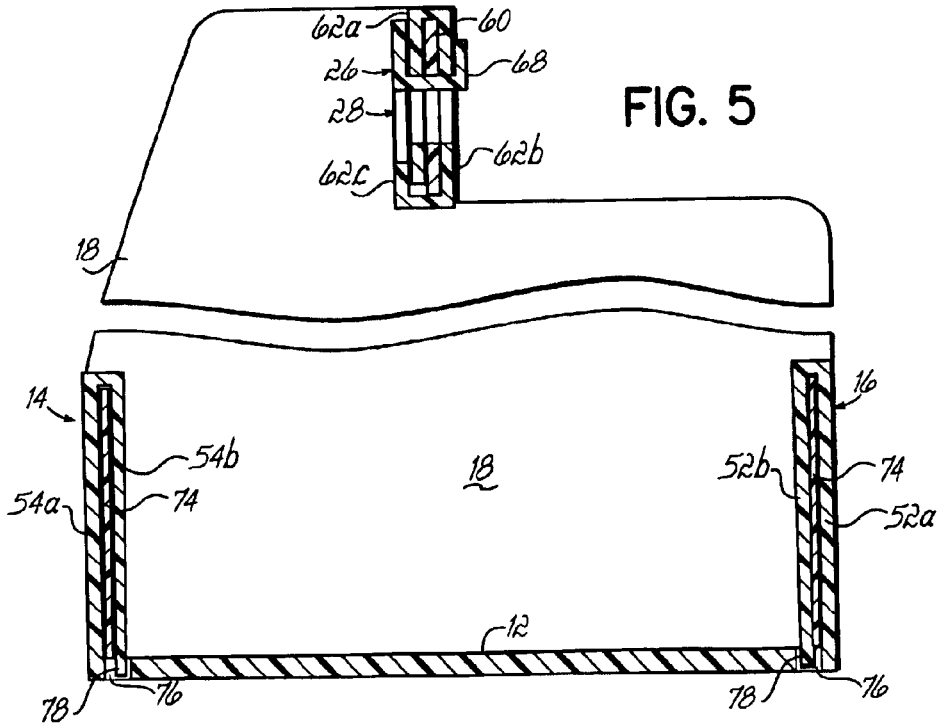
FIG. 5 is a partial cross-sectional view of the exemplary tote of FIG. 1.

Referring now to FIG. 3, the initial folding operations for forming tote 10 from blank 40 are illustrated. To form the receptacle 22, the first and second side panels 56, 58 are folded to extend in a direction generally perpendicular to bottom panel 42. To increase the strength of the assembled tote 10, the first and second flaps 72, 74 are folded inwardly such that the flaps 72, 74 extend in a direction toward oppositely facing sidewalls 56, 58. Each end panel 52, 54 is folded along lines 44, 46 to extend parallel to end flaps 72, 74, and then distal end panel portions 52*b*, 54*b* are folded over the top edges of flaps 72, 74 and then downwardly parallel to the flaps 72, 74, such that the flaps 72, 74 are sandwiched between the proximal portions 52*a*, 54*a* and distal portions 52*b*, 54*b* of the respective end panels 52, 54. Bottom panel 42 includes at least one slot 76, and preferably two slots 76, formed along each end edge 44, 46 whereby the first and second end panels 52, 54 may be secured to the bottom panel 42 by inserting corresponding tabs 78 formed along the outer edges of the distal portions 52*b*, 54*b* into the slots 76 when end panels 52, 54 are folded over the first and second flaps 72, 74 to form end walls 14, 16 of the tote 10. Advantageously, the dimensions of flaps 72, 74 can be sized to be very close to proximal panel portions 52*a*, 54*a* when folded inwardly to thereby form a tight fit when sandwiched between the proximal portions 52*a*, 54*a* and distal portions 52*b*, 54*b*. This configuration provides end walls 14, 16 having three layers of corrugated polymeric material, as best illustrated in FIG. 5.

While the exemplary tote 10 has been depicted and described as having flaps 72, 74 configured to be folded inwardly in an abutting relation to form end walls 14, 16, it will be recognized that various other configurations are possible as well. For example, flaps 72, 74 may be sized to overlap one another upon being folded inwardly, and may alternatively include features, such as tabs and slots for interlockingly engaging one another. In another exemplary embodiment, each end wall 14, 16 may comprise only a single flap hingedly joined to one of sidewalls 18, 20 and configured to engage a slot formed in the opposite sidewall when folded inwardly during the formation of end walls 14, 16.

It will also be recognized that, while exemplary tote 10 comprises first and second end panels 52, 54 having distal panel portions 52*b*, 54*b* configured to engage slots 76 formed in bottom panel 42, end panels 52, 54 may have other configurations suitable for forming end walls 14, 16. As a non-limiting example, distal panel portions 52*b*, 54*b* may be sized to extend only part way toward bottom panel 42 when folded over flaps 72, 74, and may engage slots formed in flaps 72, 74 to thereby secure end walls 14, 16 in an upstanding relation to bottom wall 12.

Referring now to FIG. 4, formation of handle portion 26 from first and second handle panels 60, 62 will now be described. After the first and second sidewalls 18, 20 have been formed by folding the first and second side panels 56, 58 upwardly from bottom panel 42, the first and second handle panels 60, 62 may be folded inwardly such that each handle panel 60, 62 extends in a direction generally toward the opposite sidewall 18, 20. The first and second handle panels 60, 62 are aligned such that first folded portion 62*a* confronts first handle panel 60 and aperture 64 in first handle panel 60 is aligned with aperture 66*a* formed in first folded portion 62*a* of the second handle panel 62. The second and third folded portions 62*b*, 62*c* are then folded to surround the first handle panel 60 and first folded portion 62*a* and to align apertures 66*b* and 70 in registration with apertures 64 and 66*a* to thereby define handle aperture 28. Tongue 68 is folded to extend through handle aperture 28 whereby the T-shape of tongue 68 engages the second folded portion 62*b* to lock the handle panels 60, 62 in the assembled configuration.

Figures 6A, 6B, 6C:
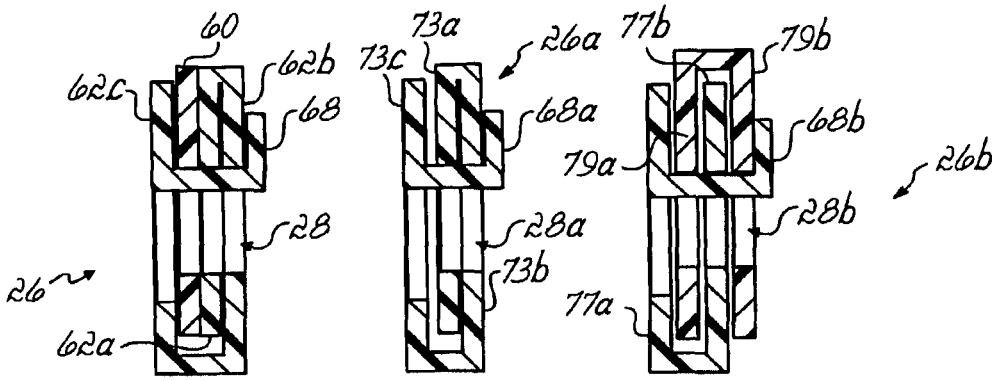
FIGS. 6A–6C are cross-sectional views illustrating additional embodiments of the handle portion of the tote.
Figure 7:
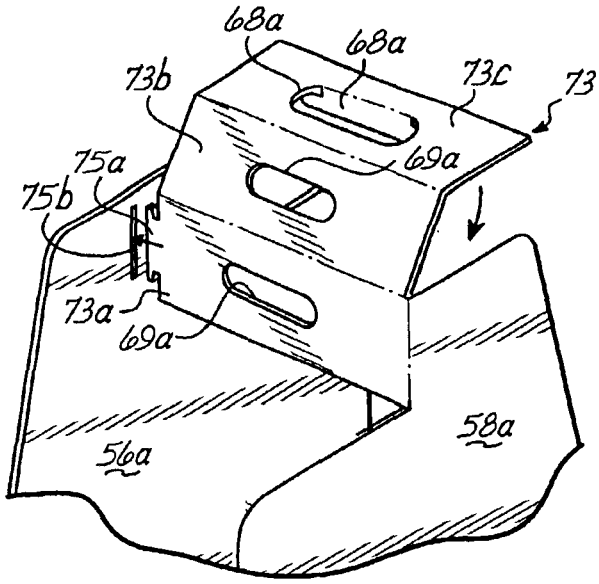
FIG. 7 is a partial perspective view illustrating a handle embodiment corresponding to FIG. 6B.

It will be recognized that other configurations are possible for forming handle portion 26 from a single blank of corrugated polymeric material. However, due to the strength requirements, the handle portion 26 must be comprised of at least three layers, and preferably a first and second handle panel 60, 62 are joined to the first and second side panels 56, 58, respectively. Further, a tongue 68 is preferred for locking the panels 56, 58 together and for covering the top edges of the handgrip aperture 28 to protect the user from cuts and discomfort while carrying heavy loads. In another exemplary embodiment shown in FIG. 6A, handle portion 26 may alternatively be formed by folding second and third folded portions 62*b*, 62*c* of second panel 62 in such a way that the first handle panel 60 is only partially surrounded by second handle panel 62. In another exemplary embodiment, handle portion 26*a* may alternatively be formed from a blank having a handle panel 73 hingedly joined to second side panel 58*a* and having a tab 75*a* for engaging a slot 75*b* formed on first side panel 56*a*, as depicted in FIGS. 6B and 7. In this exemplary embodiment, the handle panel 73 may include foldable portions 73*a*, 73*b*, and 73*c*, with apertures 69*a* and tongue 68*a*, which can be folded to create multiple layers in handle portion 26*a*, as depicted in FIG. 6B.

Figure 8:
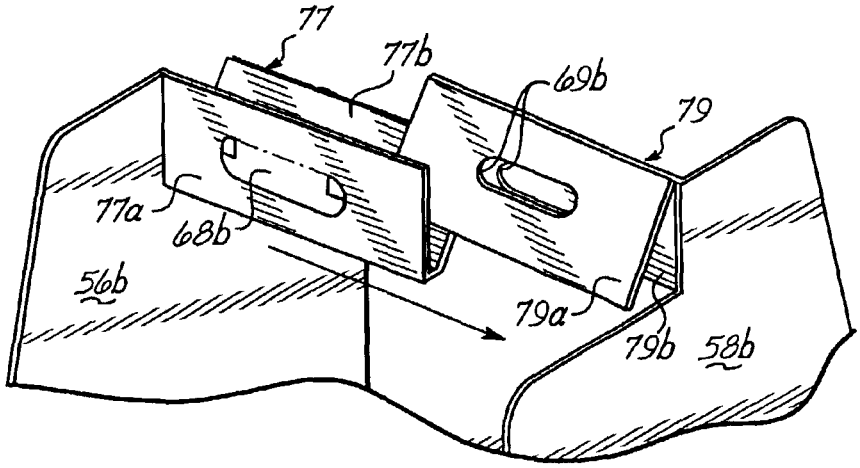
FIG. 8 is a partial perspective view illustrating a handle embodiment corresponding to FIG. 6C.

FIGS. 6C and 8 illustrate another exemplary embodiment wherein handle portion 26*b* is formed from first and second handle portions 77, 79 hingedly joined to respective first and second side panels 56*b*, 58*b* and each having first and second foldable portions 77*a*, 77*b*, 79*a*, 79*b*, with apertures 69*b* and tongue 68*b*, which may be folded to envelop a corresponding portion of the opposite handle portion when handle portions 60*b*, 62*b* are folded into a confronting arrangement, as depicted in FIG. 6C.

Figure 9A:
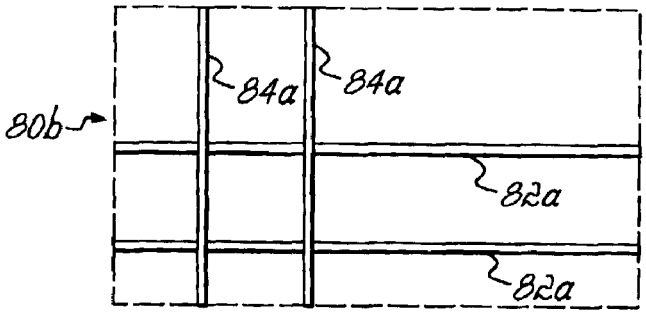
FIGS. 9A–9B are plan views depicting exemplary embodiments of alternative partitions for the tote of the present invention.
Figure 9B:
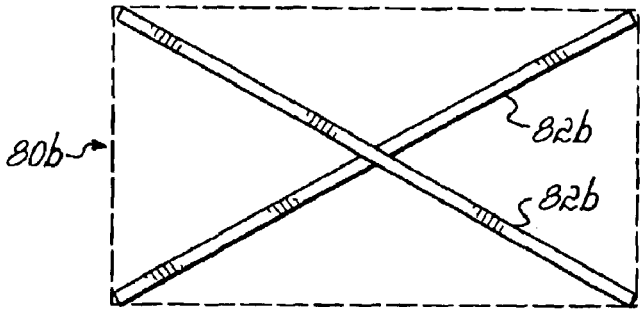

With continued reference to FIG. 4, tote 10 may further include a partition 80 which may be removably inserted within receptacle 22 to divide the receptacle 22 into various compartments. In the exemplary embodiment shown, partition 80 comprises one or more longitudinal slats 82 and one or more lateral slats 84 interconnected in a generally perpendicular relationship through engagement of slots 86 formed in the respective slats 82, 84. In the exemplary embodiment shown, partition 80 includes three longitudinal slats 82 and three lateral slats 84 formed from corrugated polymeric material and interconnected to subdivide receptacle 22 into at least eight similarly sized compartments. These compartments may be useful for securing and separating various items desired to be 10 carried in tote 10, such as chemical bottles. Alternatively, partition 80 may include a fewer number or greater number of slats 82, 84 to obtain a greater number of smaller compartments, or a fewer number of larger compartments, as may be desired. Also, the slots 86 can be differently spaced than shown in FIG. 4 to provide differently shaped and/or sized compartments. FIG. 9A depicts another exemplary partition 80*a* (shown in plan view) wherein longitudinal slats 82*a* and lateral slats 84*a* are interconnected to create generally rectangular compartments of varying size. FIG. 9B depicts yet another exemplary partition 80*b* wherein slats 82*b* are interconnected in such a way that each slat 82*b* will extend between diagonally opposed corners of receptacle 22 when inserted into tote 10. This embodiment illustrates a configuration having compartments of varying size and shape. It will be recognized by those skilled in the art that numerous other configurations of partition 80 are possible. Further, in other embodiments, the partition 80 comprises removable preformed components of various shapes and sizes for compartmentalizing the receptacle 22, thereby restricting transported objects to defined areas. Examples of preformed components are trays, racks or boxes.

An advantage of including the partition 80 is that it separates items carried within the tote, thus cushioning bottle and fragile items against bumping, and also, maintaining an orderly arrangement of items within the receptacle section 22. In addition, the partition 80 prevents taller items from tipping or falling over during transport. Further, under heavy load conditions, the partition 80 adds rigidity to the receptacle sections 22 of the tote 10, and the slats 82 help to maintain the end wall sections 52*b* and 54*b* perpendicular to the bottom panel 42, in close proximity to their respectively associated flaps 72, 74. Advantageously, the laboratory tote 10 of the present invention, excluding the insertable partition 80, may be formed from a single piece of corrugated polymeric material. If partition 80 is desired, it can be readily formed by assembly of the slats 82, 84. The unfolded blanks 40 and slats 82, 84 may be stacked flat for convenient and efficient shipping and storage. When a laboratory tote 10 is needed, a blank 40 is easily folded and erected, as described. The corrugated polymeric material provides a sturdy, lightweight tote that is chemical and tear resistant.

The tote 10 may also be provided with a partition 80 formed from corrugated polymeric material by merely assembling the slats 82, 84. The partition 80 is easily inserted and removed from the tote's receptacle 22 and may be configured to provide a variety of compartment sizes and/or shapes convenient for separately containing items within the receptacle 22, such as laboratory bottles of varying size and/or shape.

Figure 10:
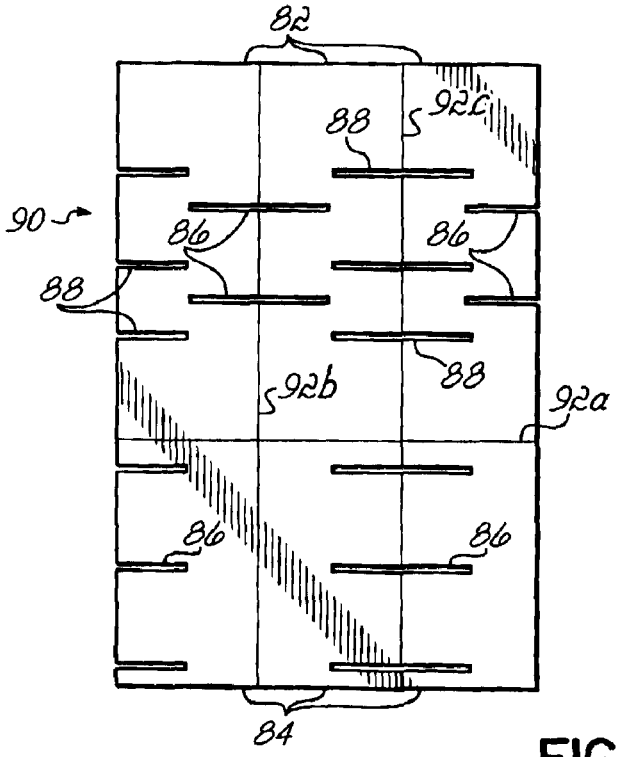
FIG. 10 is a plan view of an exemplary blank for forming an exemplary partition of the present invention.

Referring to FIG. 10, there is shown an exemplary partition blank 90 comprising frangible sections that may be separated to provide the longitudinal and lateral slats 82, 84 that form partition 80 shown in FIG. 4. Partition blank 90 may be formed by die cutting perforated lines 92*a*, 92*b*, and 92*c* into a generally rectangular sheet of corrugated polymeric material, such as that described above. Alternatively, other materials, including cardboard or non-corrugated polymeric material, may be used to form the slats or other preformed components for compartmentalization. Perforated lines 92*a*, 92*b*, and 92*c* are configured to define the longitudinal and horizontal slats 82, 84, as depicted in FIG. 10. Partition blank 90 further includes die cut slots formed through the sheet in locations corresponding to slots 86 of the respective longitudinal and lateral slats 82, 84. In the exemplary embodiment shown, longitudinal slats 82 further include additional slots 88, formed into edges opposite slots 86, to accommodate alternative partition configurations.

Advantageously, partition 80 may quickly and easily be assembled by separating the individual slats 82, 84 from partition blank 90 and connecting them as depicted in FIG. 4. Partition blank 90 thus provides a convenient way to ship and store slats 82, 84 until it is desired to assemble a partition, such as partition 80. It will be recognized, however, that various other partition configurations are possible utilizing some or all of the slats 82, 84 provided by partition blank 90.

The laboratory tote 10 of the present invention may be sterilized for re-use or, when necessary, for disposal. Sterilization may be accomplished, for example, by chemical disinfectants, gas, or irradiation; some polymers may be autoclaved. Advantageously, the exemplary tote 10 may be broken down from an erected configuration to a partially-erected or fully un-erected configuration to facilitate sterilization. In addition, the ability to break down tote 10 provides for convenient storage, when not in use, and for convenient disposal.

In an exemplary embodiment, tote 10 has an overall height H1 of approximately 13½ inches (343 mm) with a handle height H2 of approximately 3¼ inches (83 mm) and a receptacle approximately 8 inches (203 mm) wide, approximately 13 inches (330 mm) long and approximately 5¼ inches (133 mm) deep.

While the present invention has been illustrated by the description of the various embodiments thereof, and while the embodiments have been described in considerable detail, it is not intended to restrict or in any way limit the scope of the appended claims to such detail. Additional advantages and modifications will readily appear to those skilled in the art. The invention in its broader aspects is therefore not limited to the specific details, representative apparatus and methods and illustrative examples shown and described. Accordingly, departures may be made from such details without departing from the scope or spirit of the general inventive concept.

What is claimed is:

1. A container, comprising:

a bottom wall having spaced opposing bottom wall end edges and spaced opposing bottom wail side edges;

first and second spaced, generally parallel opposing end walls and first and second spaced, generally parallel opposing sidewalls, said end walls and sidewalls each disposed generally perpendicular to said bottom wall along said end edges and said side edges thereof, respectively, said end walls, sidewalls and bottom wall collectively defining a receptacle;

a handle extending between said first and second sidewalls and located above said receptacle;

the container formed from a single blank of corrugated polymeric material configured to provide a bottom panel defined by said bottom wall end edges and side edges, first end second end panels hingedly joined to said bottom panel along spaced fold lines located at said bottom wall end edges, and first and second side panels hingedly joined to said bottom panel along spaced fold lines located at said bottom wall side edges;

wherein said handle comprises a first handle panel and a second handle panel, said first handle panel extending from, and integrally connected via a fold line with, said first side panel, and said second handle panel extending from, and integrally connected via a fold line with, said second side panel, said handle panels being disposed generally parallel to, and in at least partially overlapped relation with, each other;

wherein each of said first and second handle panels comprises at least one section, each section having an opening formed therethrough, with said first handle panel comprising at least three sections of generally equal size and shape which are in interconnected along two fold lines, sad at least three sections folded to be generally parallel to each other and to said second handle panel;

wherein said handle panels are substantially perpendicular to said side panels and substantially equal in length measured in a direction perpendicular to said side panels;

wherein one of said openings is formed to define a tongue, hingedly connected to the respective section; and wherein said tongue passes through each said opening formed in each of said sections of said handle panels to collectively define a handhold aperture.

2. The container of claim 1, wherein said at least three sections of said first handle panel are folded to collectively surround said second handle panel.

3. The container of claim 1, wherein said handle is spaced above said bottom well a distance greater than or equal to the height of said end walls.

4. The container of claim 1, wherein each said end well comprises three layers of corrugated polymeric material disposed substantially parallel to each other, wherein the inner layer comprises a flap hingedly connected to one of said sidewalls and sandwiched between distal and proximal portions of the respective end panel.

5. The container of claim 4, further comprising:

at least one slot formed into said bottom panel, proximate each said bottom wall end edge; and at least one tab formed into the free edges of each said distal portion of each end panel, each said tab sized to be received into one of said slots.

6. The container of claim 1, further comprising a partition configured to be received within said receptacle to thereby divide said receptacle into a plurality of compartments.

7. The container of claim 6, wherein said partition is formed from at least two slats which ore angularly disposed relative to each other.

8. The container of claim 6, wherein said partition is comprised of one or more removable preformed components for containing objects within a defined space.

9. A blank foldable into a laboratory tote having a receptacle portion defined by a bottom well, opposing end walls, and opposing sidewalls, and further having a handle extending between the sidewalls and spaced above the receptacle portion, the blank comprising:

a single sheet of corrugated polymeric material including:

a bottom panel having opposing end edges end opposing side edges defined by fold lines formed in said sheet of corrugated polymeric material;

first and second opposing end panels respectively hingedly joined to said bottom panel along said end edges, each end panel having a proximal portion and a distal portion separated by a fold line formed in said sheet of corrugated polymeric material;

first and second opposing side panels respectively hingedly joined to said bottom panel along said side edges;

a pair of first flaps hingedly joined to said first side panel along opposing edges thereof;

a pair of second flaps hingedly joined to said second side panel along opposing edges thereof;

first and second handle panels, said first handle panel hingedly joined to said first side panel along a distal edge thereof, and said second handle panel hingedly joined to said second side panel along a distal edge thereof;

wherein said handle panel comprises three foldable sections defined by fold lines formed in said sheet of corrugated polymeric material, and said second handle panel comprises at least one section;

an opening formed in each section of said handle panels such that each opening will align upon folding of the blank to collectively form a handhold aperture;

wherein one of said openings is formed to define a tongue hingedly connected to its respective section and configured to pass through the other of said openings in said sections of said first and second handle panels upon folding of the blank to form the tote;

wherein said first and second handle panels are configured to engage one another in a confronting relationship to thereby form the handle of the laboratory tote.

10. The blank of claim 9, further comprising:

at least one slot formed into said bottom panel adjacent each said end edge; and at least one tab formed along an outer edge of said distal portion of each said end panel and configured to engage said slot;

whereby said first and second end panels may be secured in an upstanding relation with respect to said bottom panel when said distal portions are folded over said proximal portions to engage said tabs within said slots.

* * * * *

UNITED STATES PATENT AND TRADEMARK OFFICE

CERTIFICATE OF CORRECTION

PATENT NO. : 6,866,187 B2
DATED : March 15, 2005
INVENTOR(S) : Reagan et al.

It is certified that error appears in the above-identified patent and that said Letters Patent is hereby corrected as shown below:

Title page,
Item [56], References Cited, OTHER PUBLICATIONS, "Fischer Scientific" reference, "...p. 1491, date unknown." and should read -- ...p. 1401, date unknown. --.

Column 6,
Line 25, reads "...desired to be 10 carried in tote 10,…" and should read -- ...desired to be carried in tote 10,… --.

Column 7,
Line 67, reads, "...bottom wail side edges;…" and should read -- ...bottom wall side edges;… --.

Column 8,
Line 13, reads, "...first end second end panels,,," and should read -- ...first and second end panels… --.
Line 31, reads, "...sad at least three sections…" and should read -- ...said at least three sections… --.
Line 49, reads "...each said end well comprises…" and should read -- ...each said end wall comprises… --.
Line 65, reads, "...slats which ore angularly disposed…" and should read -- ...slats which are angularly disposed… --.

Column 9,
Line 5, reads, "...by a bottom well,…" and should read -- ...by a bottom wall,… --.
Line 10, reads "...opposing end edges end opposing side…" and should read -- ...opposing end edges and opposing side… --.

Signed and Sealed this

Thirtieth Day of August, 2005

JON W. DUDAS
*Director of the United States Patent and Trademark Office*